US007162877B2

(12) United States Patent
Daniels

(10) Patent No.: US 7,162,877 B2
(45) Date of Patent: Jan. 16, 2007

(54) PULSE TUBE REFRIGERATOR

(75) Inventor: Peter Derek Daniels, Northants (GB)

(73) Assignee: Oxford Magnet Technology Ltd., Eynsham (GB)

( * ) Notice: Subject to any disclaimer, the term of this patent is extended or adjusted under 35 U.S.C. 154(b) by 0 days.

(21) Appl. No.: 10/747,252

(22) Filed: Dec. 30, 2003

(65) Prior Publication Data

US 2004/0221586 A1 Nov. 11, 2004

(30) Foreign Application Priority Data

Jan. 17, 2003 (GB) ..... 0301156.6

(51) Int. Cl.
*F25B 9/00* (2006.01)

(52) U.S. Cl. ..... 62/6; 62/335

(58) Field of Classification Search ..... 62/6, 62/335

See application file for complete search history.

(56) References Cited

U.S. PATENT DOCUMENTS 5,435,136 A * 7/1995 Ishizaki et al. ..... 60/517
5,680,768 A * 10/1997 Rattray et al. ..... 62/6
5,791,149 A * 8/1998 Dean ..... 62/6
5,813,234 A * 9/1998 Wighard ..... 62/6
6,205,812 B1 * 3/2001 Acharya et al. ..... 62/607
6,374,617 B1 * 4/2002 Bonaquist et al. ..... 62/6
6,389,819 B1 * 5/2002 Zhu et al. ..... 62/6
6,640,553 B1 * 11/2003 Kotsubo et al. ..... 62/6
6,644,038 B1 * 11/2003 Acharya et al. ..... 62/6

FOREIGN PATENT DOCUMENTS

GB 2310486 A 8/1997

* cited by examiner

*Primary Examiner*—William C. Doerrler
(74) *Attorney, Agent, or Firm*—Crowell & Moring LLP

(57) ABSTRACT

A pulse tube refrigerator comprising a cold head, wherein the cold head comprises at least one pulse tube (6) and at least one regenerator (7); the cold head having a cold end (8) and a warm end (5), each end being provided with respective heat exchangers (12, 13); wherein refrigerant is supplied (3) to the cold head; and wherein the warm end heat exchanger (13) is provided with a secondary cooling mechanism (16, 17) to improve the efficiency of the PTR.

2 Claims, 3 Drawing Sheets

Prior Art

PULSE TUBE REFRIGERATOR

Pulse Tube Refrigerators (PTR's) are an effective method of producing cooling at cryogenic temperatures and can be applied to a diverse range of applications where cryogenic cooling is required. e.g. GB2310486. Single or multiple stage cooling devices can be used to assist conservation of liquid cryogens. In applications like MRI, NMR and other large scale uses of superconducting magnets it is desirable to reduce the consumption of the cryogenic liquid, usually liquid Helium cooling the magnet. Other cryogenic liquids are used for high temperature superconducting magnet systems. During operation of the PTR heat is extracted from the magnet system at the low temperature heat stations (cold end) and rejected at a higher temperature heat station (warm end) through heat exchangers. The principle of operation of PTR systems is comprehensively reported in technical literature e.g. GB 2318176. The heat exchanger located at high temperature, usually operates close to room temperature. In applications such as MRI where this heat rejection is considerable and can be typically 100W in the steady state under load or increased to 1000W during cooldown, significant temperature increase is evident at this heat exchanger. The mechanism is concerned with removing the considerable heat generated in MRI applications the size of the additional cooling area is provided as observed in experiments.

In accordance with the present invention, a pulse tube refrigerator comprises a cold head, wherein the cold head comprises at least one pulse tube and at least one regenerator; the cold head having a cold end and a warm end, each end being provided with respective heat exchangers; wherein refrigerant is supplied to the cold head; and wherein the warm end heat exchanger is provided with a secondary cooling mechanism to improve the efficiency of the PTR.

In general, a substantial secondary cooling mechanism is required and this provides additional efficiency and temperature control of the warm end. Reducing the temperature of the warm end without significantly affecting the cold end temperatures directly affects the Carnot efficiency of the PTR cycle, thereby making the system more efficient.

Preferably, the secondary cooling mechanism comprises fins and an air supply, such that the cooling is provided by airflow over the fins.

Alternatively, the secondary cooling mechanism comprises an additional heat exchanger.

In order to cool the additional heat exchanger, preferably the refrigerant is fed to the additional heat exchanger before being supplied to the cold head.

This uses the high pressure (HP) refrigerant from the compressor making the cooling circuit self contained. Using only the refrigerant flow from the compressor to effect the additional cooling, enables the system to be self contained.

Alternatively, a supplementary coolant is provided for the additional heat exchanger.

Preferably, the supplementary coolant is provided for the additional heat exchanger by bleeding a small flow of gas from the compressor high pressure side through the heat exchanger and back to the low pressure side of the compressor.

The present invention enables the high temperature heat station temperature to be controlled by providing additional cooling to the warm end heat exchangers, which thereby increases the efficiency of the PTR system.

An example of a pulse tube refrigerator according the present invention will now be described with reference to the accompanying drawings in which.

Figure 1:
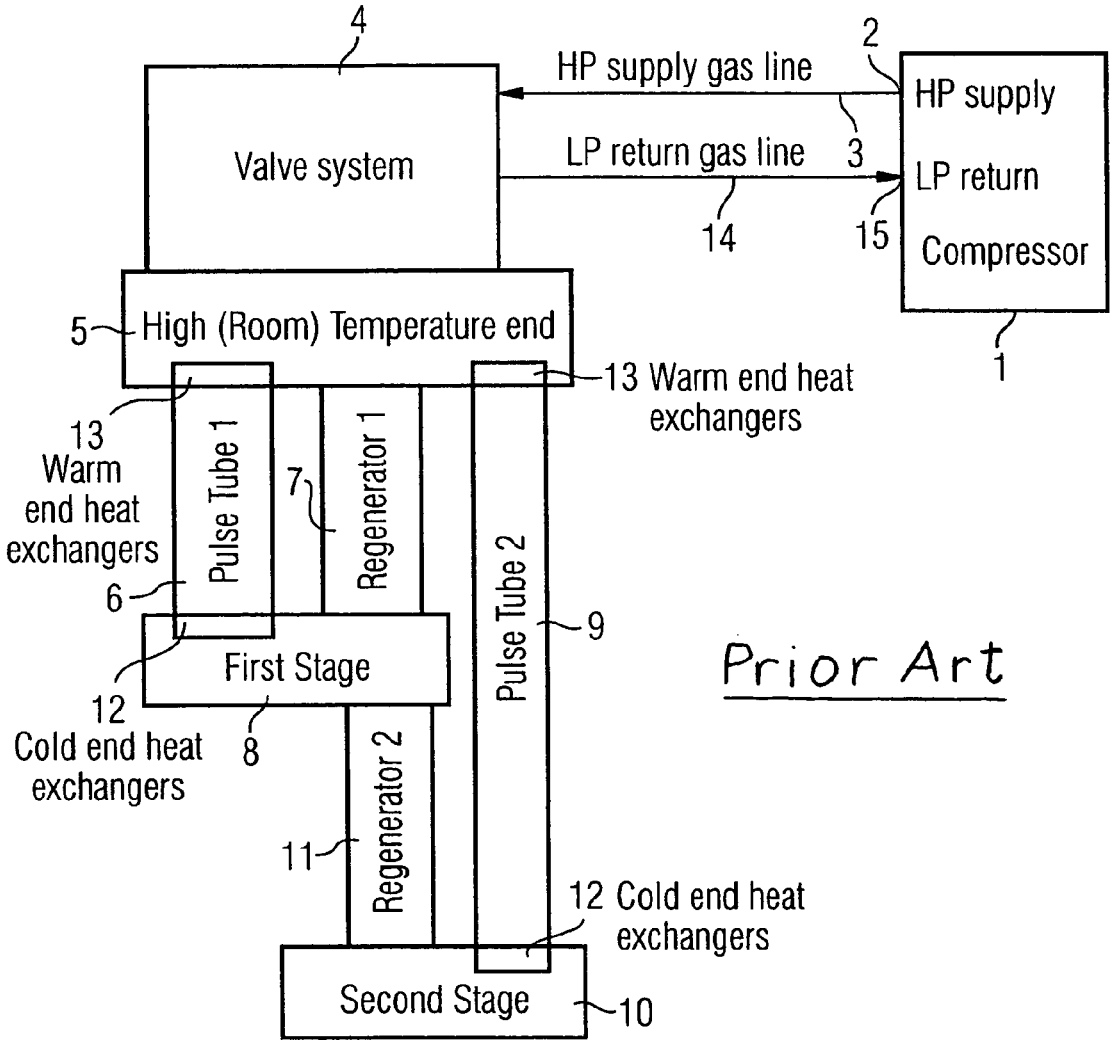
FIG. 1 shows a system configuration for a conventional two stage PTR.

FIG. 1 shows a conventional system configuration. A compressor 1 compresses refrigerant fluid, such as Helium or other suitable gas. The compressed Helium is fed from a high pressure (HP) supply outlet 2 to the HP supply gas line 3. At this point the refrigerant is at a temperature dependent upon the cooling scheme employed by the compressor. Refrigerant is fed to a valve system 4. This distributes the gas into a cold head comprising a high (room) temperature end 5, a first pulse tube 6 and first regenerator 7 connected to a first stage 8, the cold end; and a second pulse tube 9 connected between the high temperature end 5 and a second stage 10, also the cold end and a second regenerator 11. Gas flow in the cold head is ac flow in that it flows in and out through the same flow passages. Operation of the PTR produces cooling of the stages, in this case the first 8 and second 10 for a two stage refrigerator. The heat flow from the first and second stages 8, 10 is extracted through cold end heat exchangers 12 at the cold end of the first and second pulse tubes 6, 9. The corresponding heat rejection created by the PTR refrigeration cycle is rejected through warm end heat exchangers 13 at the high temperature end. The gas supply returns to the compressor from the valve system 4 via a low pressure (LP) return gas line 14 to the LP return input 15. Commercially available PTR systems tend to use only the refrigerant gas flowing from the system compressor to cool the valve part of the system. This gas is usually cooled at the compressor by water or air and distributed to the PTR cold head by means of the valve system. The valve may be attached to the cold head or remote from it. In either case the gas transport from the compressor is used in a 'passive' way to provide cooling to the high temperature heat exchangers.

Figure 2:
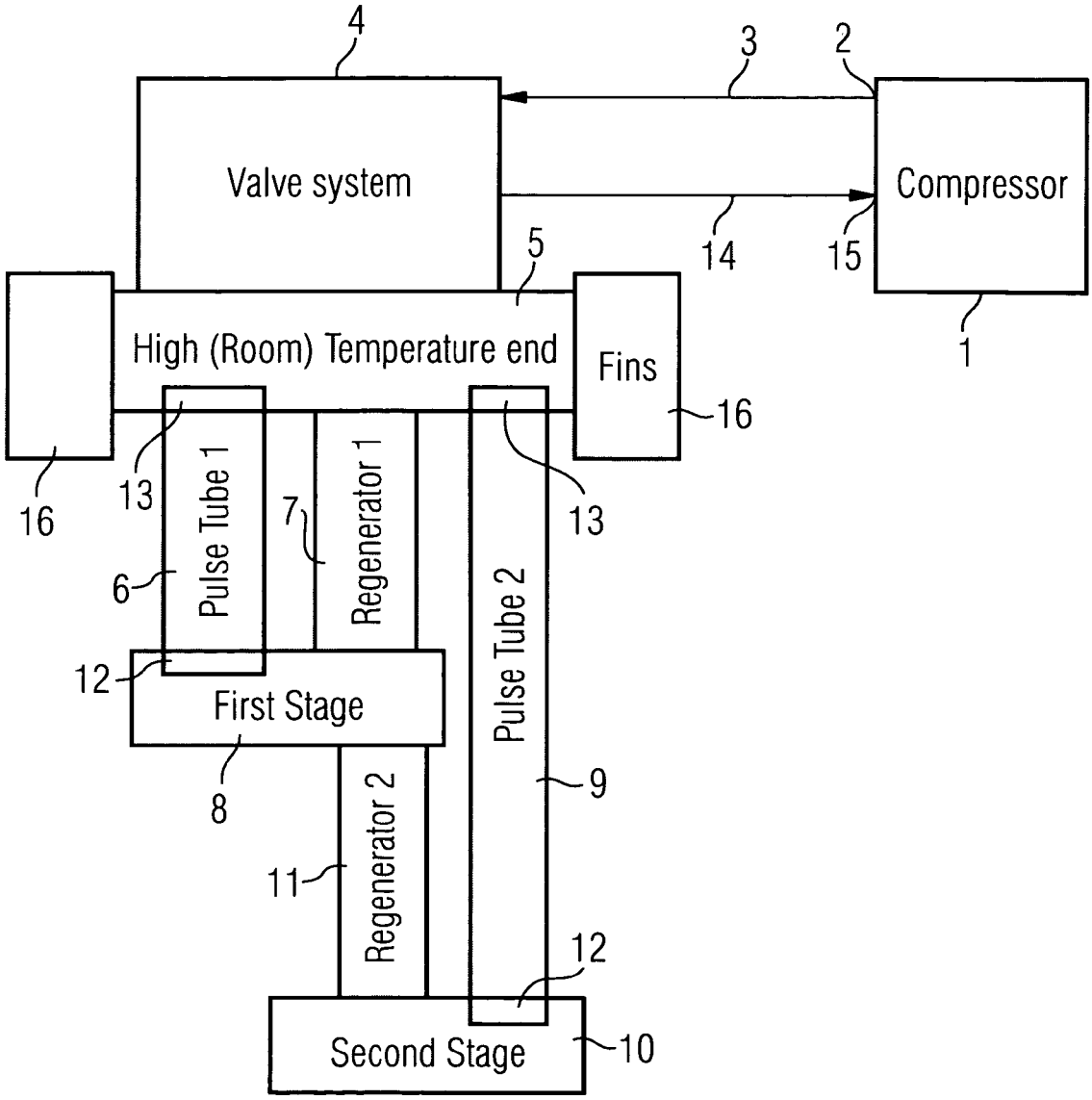
FIG. 2 shows a first example of a PTR according to the present invention.

In a first example of the present invention in which the temperature of the warm end heat exchangers is controlled by means of additional active cooling, a secondary cooling mechanism is provided in which a surface cools the high temperature end using forced air or natural air convection around the PTR. As shown in FIG. 2, natural convection air cooling fins 16 are provided at the high temperature end 5 to control the warm end heat exchanger 13 temperature. These fins 16 are substantial additions. In an example of a two stage cooler for MRI applications, a typical surface area of 5000 $mm^2$ per Watt is needed to attain the control required. Reducing the temperature of the high temperature end 5, without significantly affecting the cold end temperatures, directly affects the Carnot efficiency of the PTR cycle making the system more efficient. Additional efficiency and temperature control of the high temperature end 5 is possible by passing a forced airflow over the fins 16.

Figure 3:
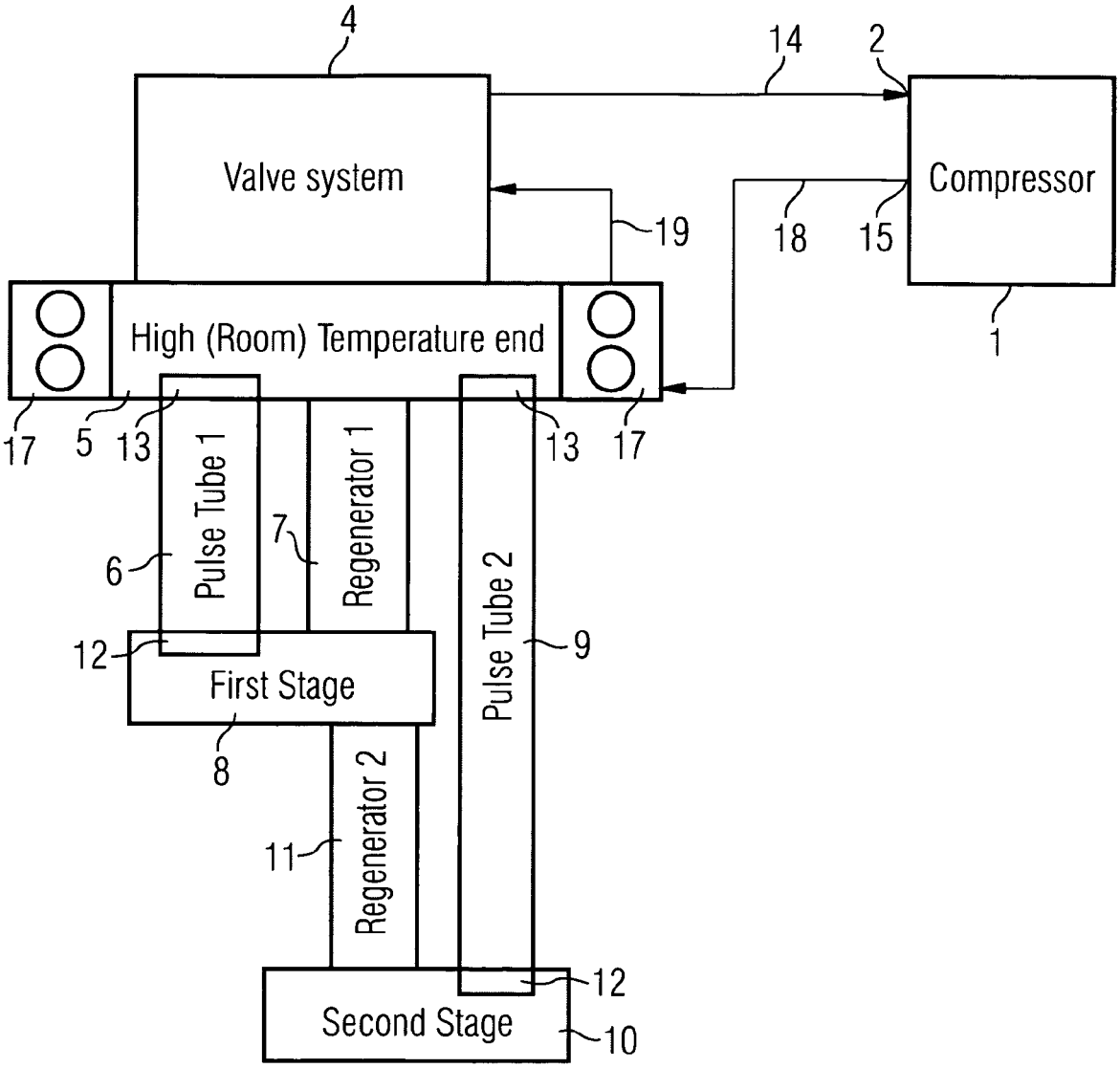
FIG. 3 shows a second example of a PTR according to the present invention.

In a second example of the present invention, as shown in FIG. 3, forced cooling using a heat transfer fluid to a secondary heat exchanger is proposed. The main refrigerant Helium gas can be used, or any other suitable liquid or gas. If the main refrigerant fluid is not used, then a separate flow circuit is required. To control the warm end heat exchanger 5 temperatures using main refrigerant flow an additional heat exchanger 17 is added to the high temperature end 5. Gas flow from the compressor 1 is fed to the heat exchanger in supply gas line 18 before passing to the valve system 4 via supply line 19. The heat exchanger 17 is a substantial addition. In an example of a two stage cooler for MRI applications a typical surface area of 200 $mm^2$ per Watt is required to attain the control required. Reducing the temperature of the high temperature end 5, without significantly affecting the cold end temperatures directly affects the Carnot efficiency of the PTR cycle making the system more efficient.

Alternatively, if the main refrigerant from the compressor is not passed through the heat exchanger, but a supplementary coolant, water for example is used instead, then a separate flow circuit (not shown) is used to pass the fluid around-the heat exchanger 17. Any suitable fluid can be used. One such arrangement is to bleed a small amount of high pressure gas from the compressor through the heat exchanger and direct back to the compressor low pressure side entering the PTR.

The methods outlined here describe how a suitable supplementary heat exchanger is fixed as an integral or additive feature to the high temperature heat exchangers on a two stage PTR. The methods are generally applicable to a PTR with any number of stages.

The invention claimed is:

1. A pulse tube refrigerator comprising a cold head that includes at least one pulse tube and at least one regenerator; wherein, the cold head has a cold end and a warm end;

each end is provided with a respective heat exchanger;

refrigerant is supplied to the cold head;

the heat exchanger at the warm end is provided with a secondary cooling mechanism to improve the efficiency of the PTR;

the secondary cooling mechanism comprises an additional heat exchanger;

the refrigerant is fed to the additional heat exchanger before being supplied to the cold head; and a supplementary coolant is provided for the additional heat exchanger by bleeding a small flow of gas from the compressor high pressure side through the additional heat exchanger and back to the low pressure side of the compressor.

2. A pulse tube refrigerator comprising a cold head that includes at least one pulse tube and at least one regenerator; wherein, the cold head has a cold end and a warm end;

a warm end heat exchanger is provided at a high temperature end of the pulse tube, and a cold end heat exchanger is provided at a cold end of the pulse tube;

refrigerant is supplied to the cold head from a compressor;

the warm end heat exchanger is provided with an additional secondary cooling mechanism comprising an additional heat exchanger, such that the warm end heat exchanger temperature is controlled, thereby improving the efficiency of the pulse tube refrigerator;

the additional heat exchanger is cooled by the refrigerant; and the refrigerant is fed to the additional heat exchanger before being supplied to the cold head.

* * * * *